US005342216A

United States Patent [19]

Davis et al.

[11] Patent Number: 5,342,216

[45] Date of Patent: Aug. 30, 1994

[54] JACKSCREW MECHANISM

[75] Inventors: Wayne S. Davis, Harrisburg; Robert N. Whiteman, Jr., Middletown; Michael E. Shirk, Grantville, all of Pa.

[73] Assignee: The Whitaker Corporation, Wilmington, Del.

[21] Appl. No.: 104,519

[22] Filed: Aug. 10, 1993

Related U.S. Application Data

[63] Continuation of Ser. No. 7,938, Jan. 25, 1993, abandoned, which is a continuation-in-part of Ser. No. 955,554, Oct. 1, 1992, abandoned, and a continuation-in-part of Ser. No. 4,859, Jan. 15, 1993.

[51] Int. Cl.[5] ..... H01R 13/00

[52] U.S. Cl. ..... 439/362

[58] Field of Search ..... 439/359-365, 439/607-610

[56] References Cited

U.S. PATENT DOCUMENTS

| | | | |
|---|---|---|---|
| 3,056,942 | 10/1962 | Carbaugh et al. | 439/362 |
| 3,582,867 | 6/1971 | Thompson et al. | 439/362 |
| 3,760,335 | 9/1973 | Roberts | 339/99 R |
| 4,577,919 | 3/1986 | Waters | 439/362 |
| 5,158,474 | 10/1992 | Frantz | 439/362 |
| 5,158,481 | 10/1992 | Frantz | 439/607 |

*Primary Examiner*—Joseph H. McGlynn

[57] ABSTRACT

A kit of parts for a jackscrew mechanism (1) comprising, first and second cover parts (8) to encircle an electrical connector (19), locking structure (160, 162) on the cover parts (8) adapted to lock the cover parts (8) together prior to receiving separate jackscrews (16) in passages (9) in the cover parts (8), a locking finger (164) in each of the passages (9) adapted to lock behind a collar (198) on a respective jackscrew (16), each jackscrew (16) having an enlarged diameter portion (200) to resist pivoting of the jackscrew (16) while the collar (198) remains in front of the locking finger (164), and a series of ramps (168) along the passages (9) over which the jackscrews (16) glide.

20 Claims, 8 Drawing Sheets

JACKSCREW MECHANISM

GROSS REFERENCE TO RELATED APPLICATION

This application is a continuation of application Ser. No. 08/007,938 filed Jan. 25, 1993 (15383), now abandoned, in turn, a continuation in part application of application Ser. No. 07/955,554 filed Oct. 1, 1992 (15319), now abandoned, and a continuation in part application of application Ser. No. 08/004,859 filed Jan. 15, 1993 (15320).

FIELD OF THE INVENTION

The field of the invention pertains to a jackscrew mechanism for attachment of an electrical connector to a mating electrical connector.

BACKGROUND OF THE INVENTION

There is disclosed in U.S. Ser. No. 5,158,481, a shielded electrical connector comprising; a terminal support block, contact terminals supported on the block for connection to wires, and shielding for the connector comprising; a mating end on a front shell encircling a mating end of the terminal support block, and conductive backshells enveloping the block. A jackscrew mechanism comprises; jackscrews rotatably mounted in an insulating composite cover, the cover enveloping the backshells. Before the separate parts of the composite cover are assembled and locked together, the backshells and both jackscrews must be laid carefully in one of the cover parts. Difficulty is experienced in assembling and locking the cover parts together while holding the loose parts, the backshells and jackscrews, in place. The difficulty is increased when it is necessary to use tooling apparatus to apply sufficient force to press the cover parts together until they interlock. Once the cover parts are assembled and locked together, the cover and the jackscrews are unable to be disassembled without a risk of damaging the cover.

A desirable jackscrew mechanism would have a cover that is fully assembled to the connector without the jackscrews, which reduces the difficulty involved in assembling and locking the cover parts to one another while trying to hold the other loose parts in their positions. The jackscrews, subsequently assembled, would become locked for rotation with respect to the cover. The jackscrews would be held in the cover in such a manner that the jackscrews were unable to pry apart the cover parts.

SUMMARY OF THE INVENTION

According to a feature of the invention, a jackscrew mechanism for a connector comprises a cover of insulative cover parts constructed for assembly without accompanying jackscrews to an electrical connector. Once the jackscrews have been assembled, the jackscrews and the cover are interlocked for rotation of the jackscrews with respect to the cover.

An advantage of the invention resides in an insulative cover fully assembled to a connector, and adapted with cavities to receive jackscrews and adapted with locking fingers, which permits subsequent assembly of jackscrews in the cavities, and interlocking of the jackscrews with the cover for rotation of the jackscrews with respect to the cover.

Another advantage of the invention resides in a cover, constructed of cover parts, having a seamless jackscrew entrance opening that prevents the jackscrew in the opening from prying apart the cover parts.

Another advantage of the invention resides in ramps within jackscrew receiving cavities that urge the jackscrews along the cavities without binding, and align the jackscrews along the cavities during interlocking of the jackscrews with the covers. The ramps are in the same cover part as the seamless jackscrew entrance to prevent the jackscrew from prying apart the cover parts.

DESCRIPTION OF THE DRAWINGS

An embodiment of the invention will now be described, by way of example, with reference to the accompanying drawings, according to which.

DETAILED DESCRIPTION

Figure 1:
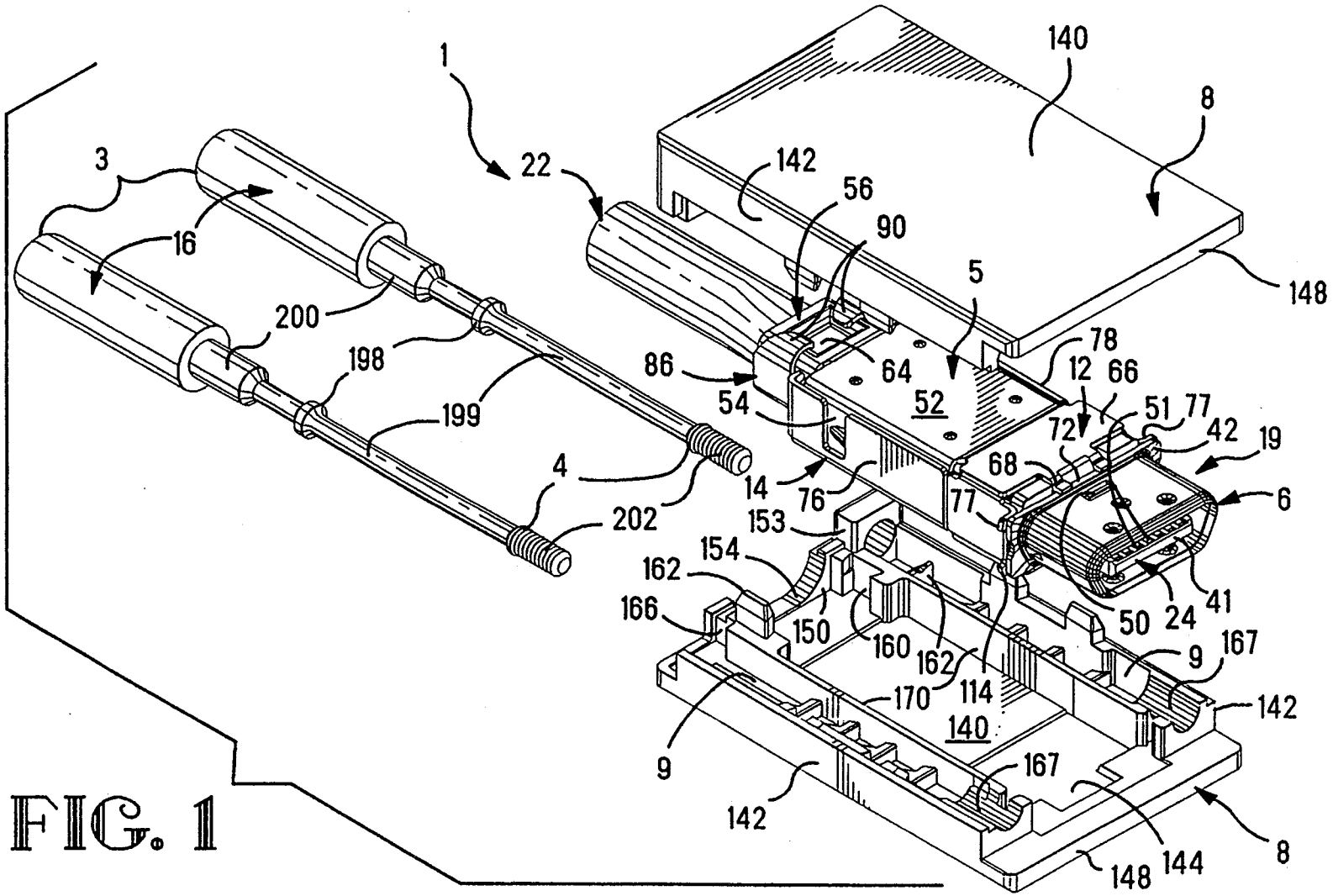
FIG. 1 is a perspective view of a shielded electrical connector and a jackscrew mechanism with parts separated from one another.

With reference to FIG. 1, a shielded plug type connector 19 comprises an insulative plug connector section 24 projecting forwardly for mated connection with a shielded receptacle type, mating connector, not shown. The plug connector section 24 includes a forwardly protruding terminal support block 41 supporting multiple contact terminals 51 having wire terminating portions for connection to insulated wires, not shown, of a shielded multiple wire cable 22.

Conductive electrical shielding 5 is provided by a unitary drawn metal front shell 6 and an upper metal backshell 12 and a lower metal backshell 14.

The backshell 12 is of unitary construction stamped and formed from sheet metal. The backshell 12 comprises an upper wall 52 and depending sidewalls 54 providing an inverted channel. At a rear of the backshell 12 is an anchoring member 56 for the lower backshell 14. A recess 64 is formed as a deep depression in the upper wall 60. A plate 66 is offset from the plane of the wall 52 and extends forwardly. A pair of forward extending tabs 68 and a curved, pivot hook 72 project forwardly to engage the front shell 6, with the hook 72 being received in a laterally extending slot 50 in the front shell 6.

The backshell 14 is of unitary construction stamped and formed from sheet metal. The backshell 14 comprises sidewall sections 76, 78 upstanding from a lower wall and defining a channel. Laterally outward turned flanges 77 are on front ends of the sidewall sections 76, 78. From a rear of the backshell 14 projects a cable strain relief member 86 comprising anchoring flanges 90 secured to the anchoring member 56 with the flanges 90 entering the recess 64. Forward of the backshell 114 project tabs 68, not shown, and a pivot hook 72, not shown, similar in construction as described in conjunction with the backshell 12, and with which the backshell 14 is hooked and attached to the front shell 6 to envelop the connector 41. Further details of the backshell 12 and the backshell 14 are discussed in U.S. Pat. No. 5,158,481. Laterally projecting flanges 114 on the backshell 14 engage a laterally projecting flange 42 on the rear of the drawn front shell 6. Further details of the front shell 6 and of the connector 19 are disclosed in U.S. Pat. No. 955,554, filed Oct. 1, 1992 (15319).

With reference to FIG. 1, a jackscrew mechanism 1 comprises, duplicate jackscrews 16 and a cover 2 comprising duplicate cover parts 8. Each of the duplicate jackscrews 16 has a rear knob 3, used for turning the jackscrew manually. The knob 3 is of enlarged diameter on a rear end of an enlarged diameter portion 200 on a reduced diameter body or shaft 199, a radially enlarged collar 198 and a threaded front end section 202 for threaded connection to another jackscrew, not shown, of a mating connector, not shown. The collar 198 has a conically tapered front. A radially enlarged, torroidal rim 4 is at the rear of the threaded section 202.

Figure 4:
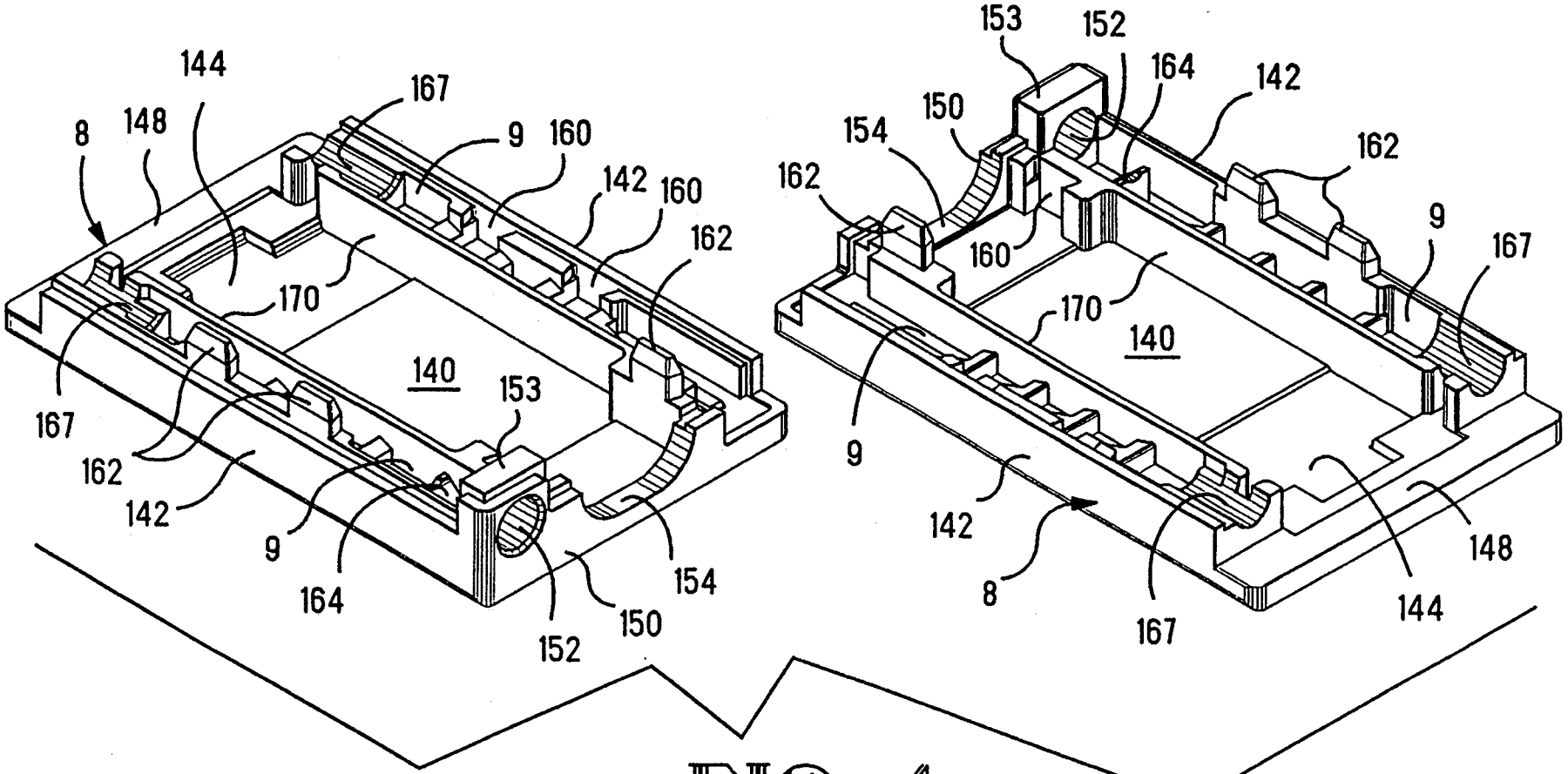
FIG. 4 is a perspective view of cover parts of the jackscrew mechanism as shown in FIG. 1.

With reference to FIG. 4, the duplicate cover parts 8 are of unitary construction, and are fabricated by molding a dielectric material. Each cover part 8 comprises, a major wall 140 and exterior, upstanding side walls 142, 170 defining an interior for encircling part way around the connector 19. Each pair of side walls 142, 170 defines a channel of a passage 9 formed when the channels of the cover parts 8 opening into one another. Each passage 9 is for receiving one of the jackscrews 16. The shielding 5 of the connector 19 comprising, the front shell 6 and the backshells 12, 14, is partially encircled by an interior of the cover part 8. The plate 66, FIG. 1, at a front of the shielding is covered by a forward part 144 of the wall 140 at an open forward or front end 148. An upstanding rear wall 150 encloses the anchoring member 56 and the strain relief member 86. A central, cable egress opening 154 of flattened semicircular shape is in the edge of the rear wall 150, such that when the cover parts 8 are assembled to each other, the openings 154 of the cover parts 8 open into one another and form a composite cylindrical opening 154. The opening 154 encircles the cable 22.

Projecting posts 162 of each one cover part 8 have wedge tips that insert along post receiving sockets 160, FIG. 4, recessed in the other cover part 8. The posts 162 are rectangular, and are inserted with an interference fit within the sockets 160 that are channel shaped. The cover parts 8 are locked together by the posts 162 and sockets 160. The posts 162 project from respective walls 142 and 170. The sockets 160 are recessed in respective walls 142 and 170.

A cylindrical, seamless entrance opening 152 is completely encircled and reinforced by a thickened block 153 on the rear wall 150 opens into a rear end of a first one of the channels 9. A transverse wall or locking finger 164 bridges across the passage 9 and is spaced from the rear wall 150 and from the block 153. A rear of the finger 164 is a wedge shaped, inclined ramp 165, FIG. 4, facing toward the rear and toward the rear wall 150. The other passage 9 is open at a rear end and is shaped with a recess 166 to interfit with the block 153 of the other duplicate cover part 8.

Front ends of the passages 9 are bridged across by semicylindrical and recessed, arcuate trough, bearing blocks 167 against which the torroidal rims 4 of the jackscrews 16 rest for rotation with respect to the cover parts 8. Each of the passages 9 is bridged across by a series of recessed, wedge shaped, inclined ramps 168 facing to the rear and toward the rear wall 150.

Figure 5:
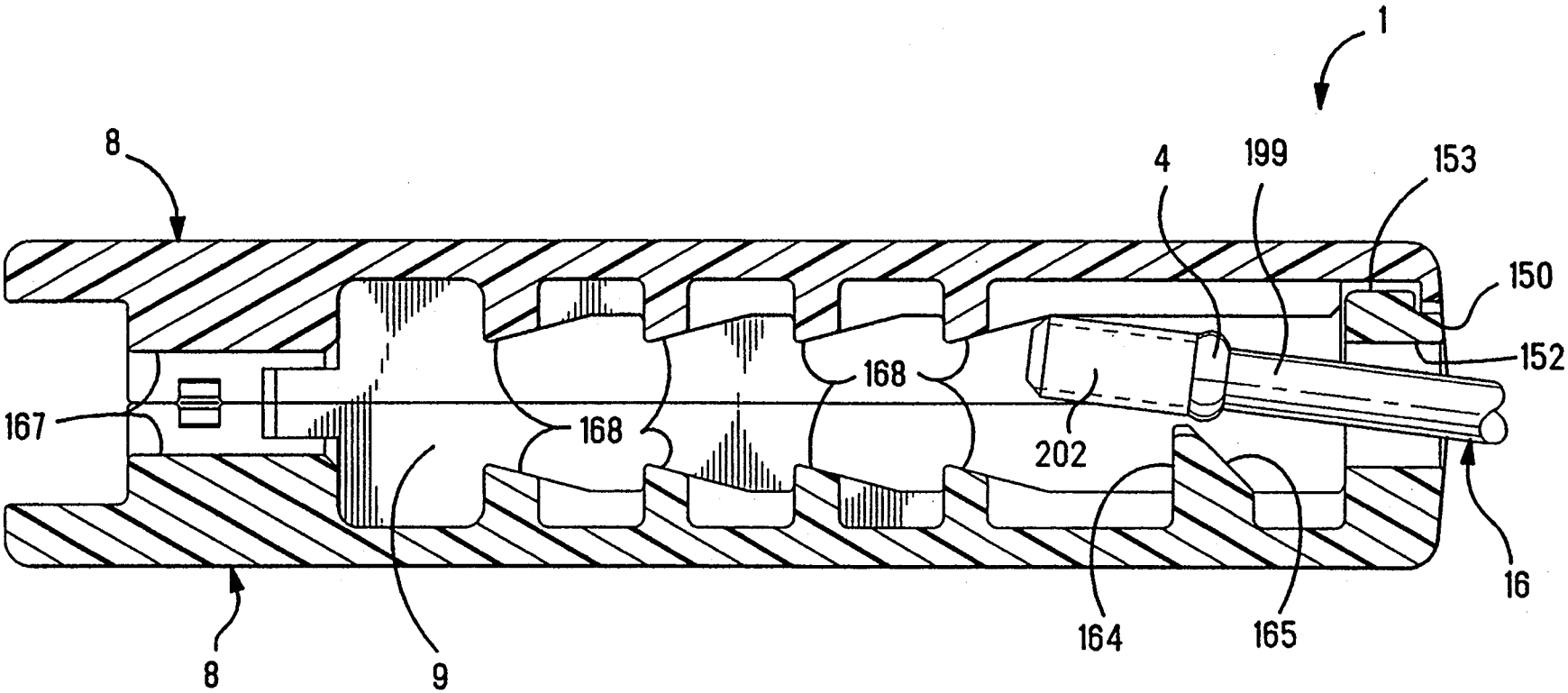
FIGS. 5 through 8 are longitudinal section views of the jackscrew mechanism as shown in FIG. 3, illustrating a jackscrew at various positions along the cover parts.

With reference to FIGS. 5, each jackscrew 16 is inserted with the threaded section 202 through a respective opening 152. The jackscrew 16 is inclined obliquely, at first, to permit the threaded section 202 and the rim 4 to glide over the ramp 165 on the finger 164 as the jackscrew 16 continues to move forwardly along the passage 16. Once the rim 4 is past the ramp 165, the threaded section 202 glides against a first in the series of ramps 165 in the passage 9, which tends to straighten the length of the jackscrew 16 with respect to the axis of the passage 9. Each passage 9 has the entrance opening 152 intercepted by a conic angle having an apex at the tip of the locking finger 164 and inclined from the apex at an angle intercepting a circumference of the entrance opening 150. Each jackscrew 16 is constructed with a width permitting the jackscrew 16 to intercept the entrance opening 152 while being inclined at the conic angle. Since the opening 152 is seamless and is reinforced by the surrounding block 153, the jackscrew 16, even operating as a lever against a side of the opening 152, is unable to pry apart the cover parts 8. Since the ramps 168 are together with the opening 152 in the same cover part 8, instead of having the ramps 168 entirely in a different cover part 8 than the opening 152, the jackscrew 16 is unable to operate as a lever to bend the cover parts 8.

Figure 6:
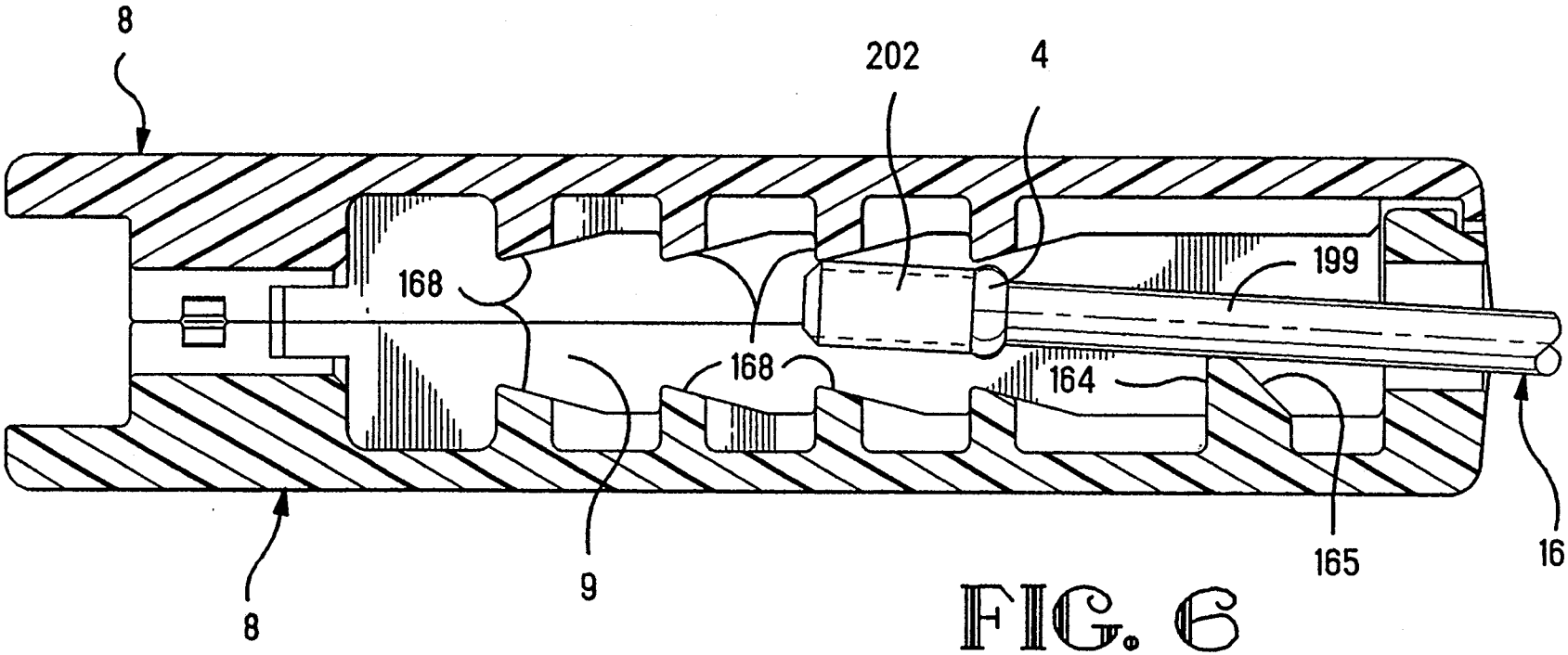

A first one of the ramps 168 in each passage 9 is spaced from the locking finger 164 a distance not less than the length of the threaded section 202 of each jackscrew 16, FIG. 5, which permits the jackscrew 16 to be inclined before moving forward to glide over the first ramp 168. In FIG. 6, the first one of the ramps 168 is spaced from the corresponding locking finger 164 a distance not less than a distance from a front end of each jackscrew 16 to a rear of the rim 4.

Figure 7:
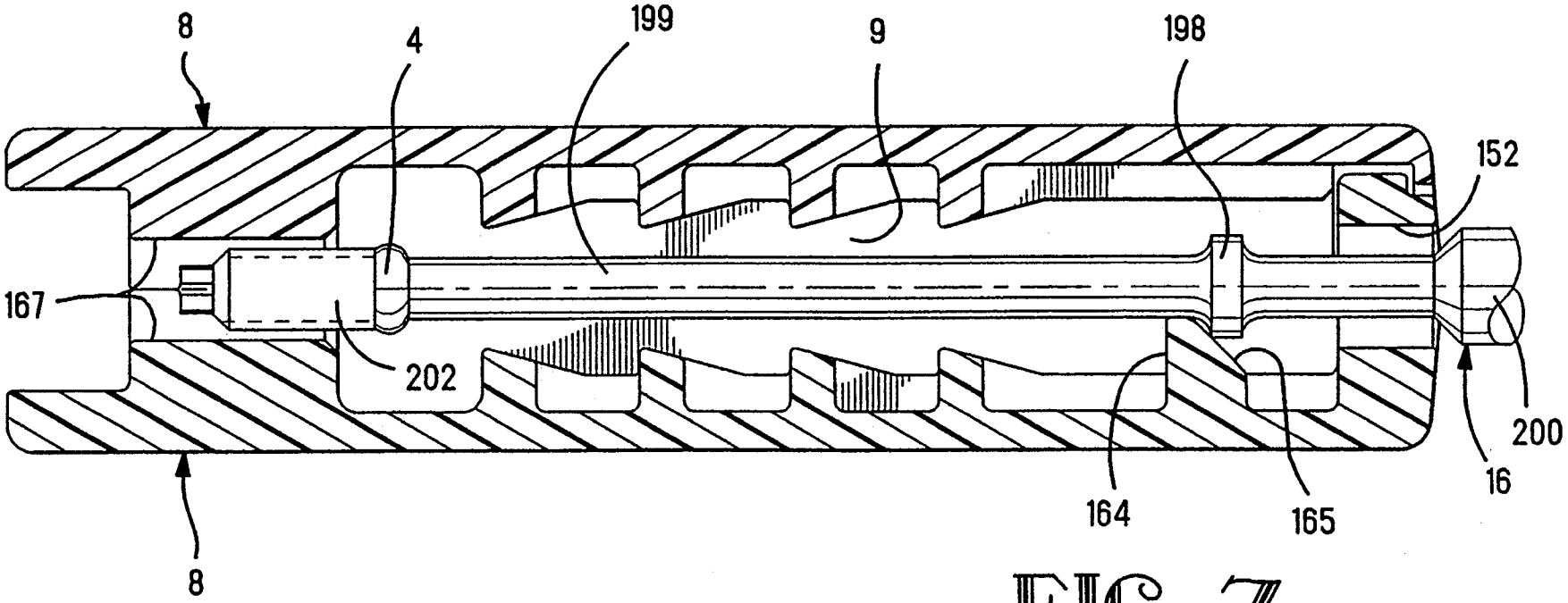

As the jackscrew 16 continues to move forwardly, FIG. 6, the ramps 116 will guide the length of the jackscrew 16 to straighten, as the jackscrew 16 glides over them. The jackscrew 16 will be guided to locate the shaft 199 to move closer to the tip of the finger 164. The jackscrew 16 will be guided to enter the bearing blocks 167, FIG. 7. Once the jackscrew 16 is within the bearing blocks 167, the collar 198 is moved forward in preparation for gliding over the ramp 165 of the finger 164. The width of the shaft 199 is smaller than the opening 152, which permits the jackscrew 16 to pivot in the opening 152 while the collar 198 glides over the ramp 165 of the locking finger 164. The distance between the bearing blocks 167 and the locking finger 164 is less than the length of the jackscrew 16 from a front end to the collar 198, which assures that the jackscrew 16 is supported by the bearing blocks 167 while the jackscrew 16 pivots. The circumference of the collar 198 is larger than the circumference of the rim 4. The collar 198 is restrained by the locking finger 164 against movement in a rear direction, once the collar 198 has moved forwardly beyond the locking finger 164. Once the collar 198 passes by the finger 164, a backside of the finger 164 locks against the collar 198 to resist withdrawal of the collar 198 in a rearward direction. The enlarged diameter portion 200 will have moved forwardly to fill the opening 152 to resist the shaft 199 from pivoting to such an extent that the collar 198 can move rearward of the locking finger 164.

Figure 8:
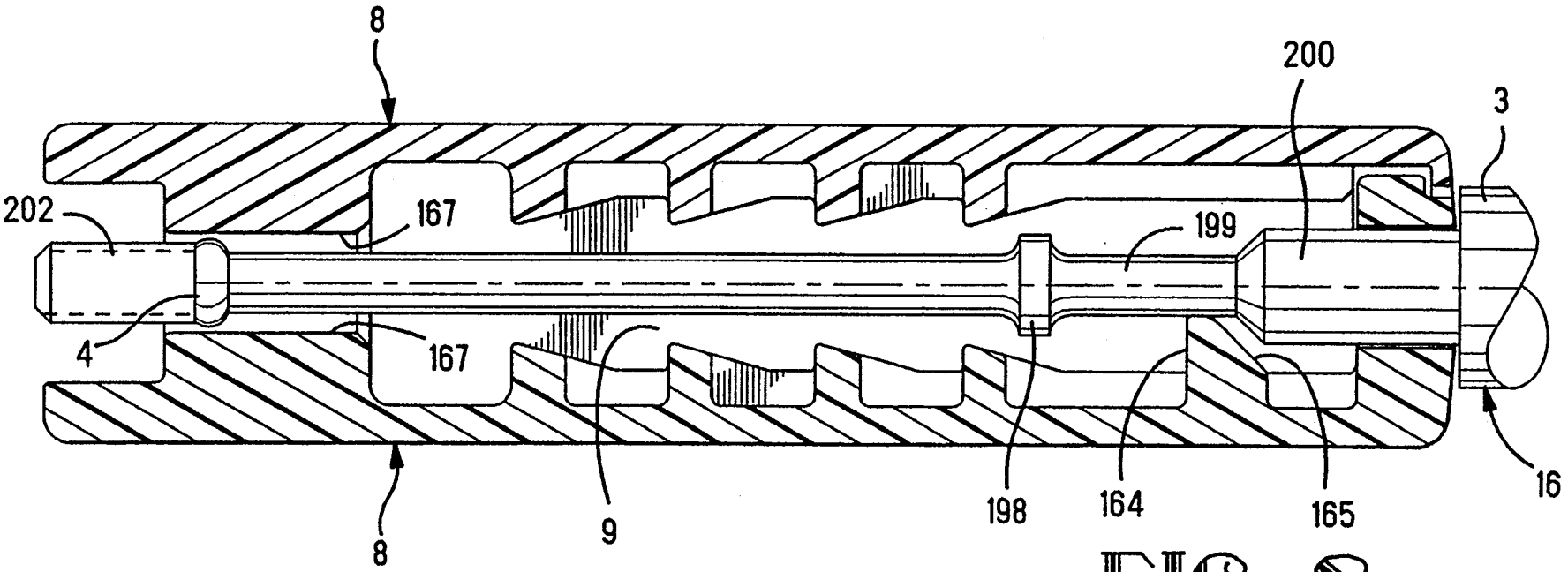

With reference to FIG. 8, the knob 3 of each jackscrew 16 has a circumference larger than a circumference of each of the passages 9, and larger than the circumference of each of the entrance openings 50 to limit further movement of the jackscrews 16 forwardly along the passages 9. The rims 4 adjacent the threaded sections 202 are received within the bearing blocks 167 and will support the threaded section 202 from being in contact with the bearing blocks 167.

Figure 2:
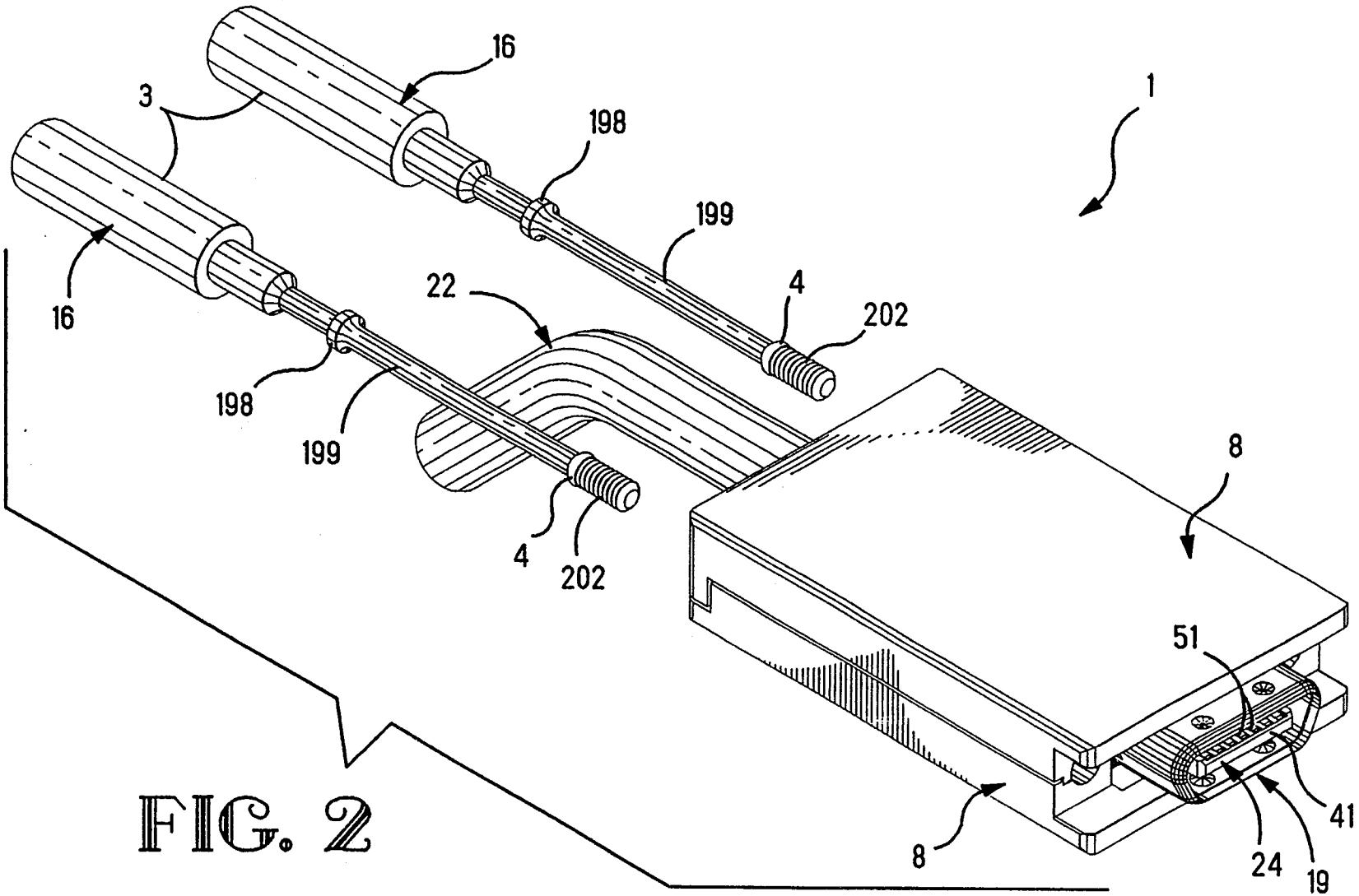
FIG. 2 is a perspective view of the connector and the jackscrew mechanism shown in FIG. 1.
Figure 3:
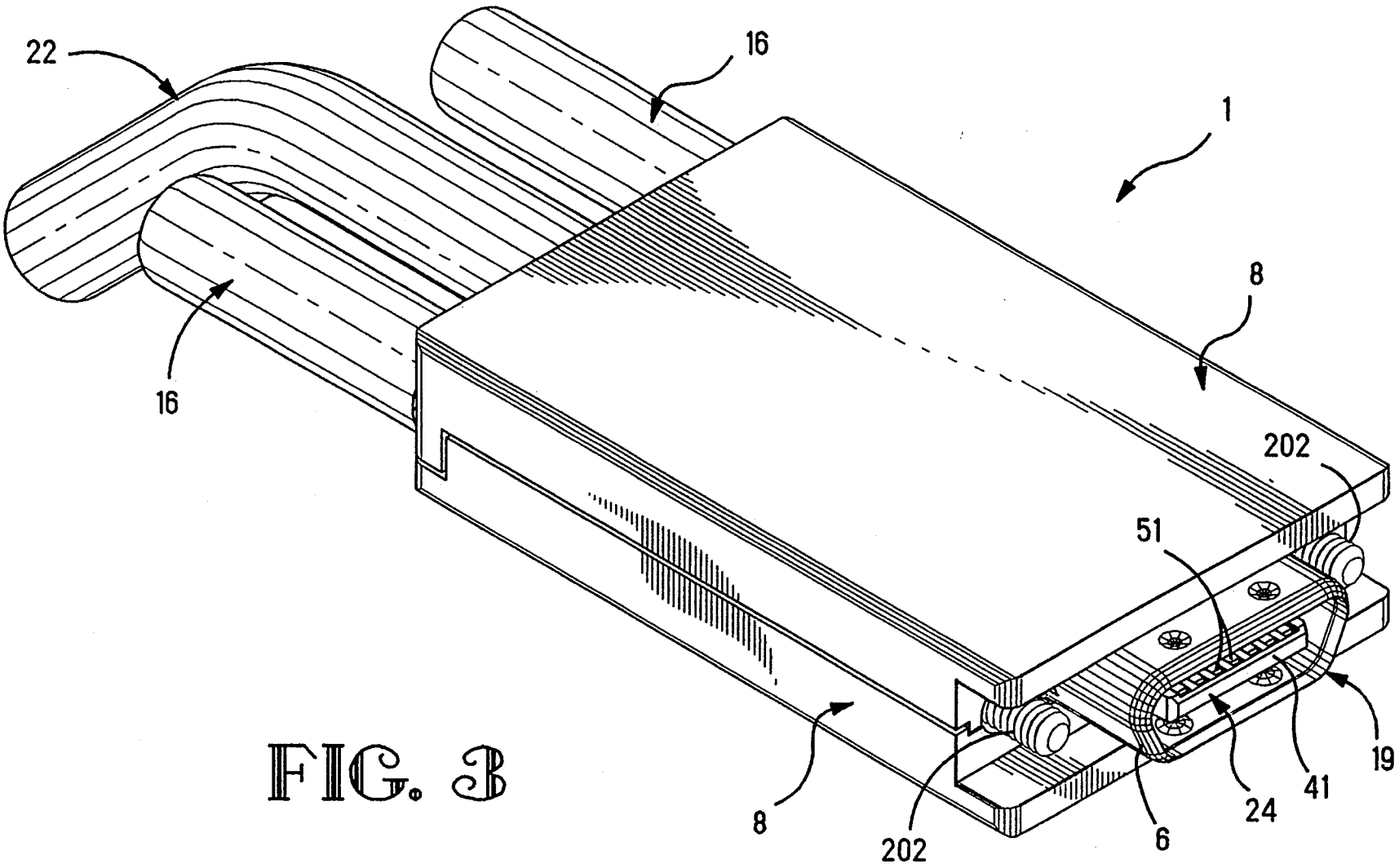
FIG. 3 is a view similar to FIG. 2 with the parts fully assembled together.

According to an advantage of the invention, the jackscrew mechanism 1 can comprise a kit of parts adapted for assembly with a connector 19. According to another advantage of the invention, the cover parts 8 are fully assembled to the connector 19, FIG. 2, without the jackscrews 16, which reduces the number of separate parts, and which permits selection of different types of jackscrews 16 appropriate for use with the connector 19 at the time and location that the connector 19 is placed into service. The jackscrews 16 are assembled, FIG. 3, subsequently, to be locked for rotation with respect to the cover parts 8.

Other embodiments, objects and advantages of the invention are intended to be covered by the spirit and scope of the appended claims.

We claim:

1. A kit of parts for a jackscrew mechanism comprising: first and second cover parts adapted with an interior to encircle an electrical connector, jackscrew receiving passages in the cover parts, locking structure on the cover parts adapted to lock the cover parts together prior to receiving separate jackscrews in the passages, a locking finger in each of the passages adapted to lock behind a collar on a respective jackscrew, and jackscrews, each jackscrew having a front threaded section and a projecting collar and a knob.

2. A kit of parts as recited in claim 1, wherein the knob of each jackscrew has a circumference larger than a circumference of each of the passages.

3. A kit of parts as recited in claim 1, comprising: a series of ramps along each of the passages over which the jackscrews glide.

4. A kit of parts as recited in claim 3, wherein a first one of the ramps in each passage is spaced from the corresponding locking finger a distance not less than the length of the threaded section.

5. A kit of parts as recited in claim 1, wherein each passage has an entrance opening intercepted by a conic angle having an apex at the tip of the locking finger and inclined from the apex at an angle intercepting a circumference of the entrance opening, and each jackscrew is constructed with a width permitting the jackscrew to intercept the entrance opening while being inclined at the conic angle.

6. A kit of parts as recited in claim 5, comprising: a series of ramps along each of the passages over which the jackscrews glide, and a first one of the ramps in each passage being spaced from the locking finger a distance not less than the length of the threaded section of each jackscrew.

7. A kit of parts as recited in claim 1, comprising: arcuate trough, bearing blocks at front ends of the passages encircling the jackscrews.

8. A kit of parts as recited in claim 7, wherein enlarged rims adjacent the threaded sections are received within the bearing blocks.

9. A kit of parts as recited in claim 1, comprising: enlarged rims adjacent the threaded sections.

10. A kit of parts as recited in claim 9, comprising: a series of ramps along each of the passages over which the jackscrews glide, and a first one of the ramps in each passage being spaced from the corresponding locking finger a distance not less than a distance from a front end of each jackscrew to a rear of the rim.

11. A kit of parts as recited in claim 9, wherein for each of the jackscrews the circumference of the collar is larger than the circumference of the rim, and the collar is restrained by the locking finger against movement in a rear direction, once the collar has moved forwardly beyond the locking finger.

12. A kit of parts for a jackscrew mechanism comprising: first and second cover parts adapted with an interior to encircle an electrical connector, jackscrew receiving passages in the cover parts, locking structure on the cover parts adapted to lock the cover parts together prior to receiving separate jackscrews in the passages, a series of ramps along each of the passages over which the jackscrews glide, and jackscrews, each jackscrew having a front threaded section and a projecting collar and a knob.

13. A kit of parts as recited in claim 12, wherein the knob of each jackscrew has a circumference larger than a circumference of each of the passages.

14. A kit of parts as recited in claim 12, comprising: enlarged rims adjacent the threaded sections.

15. A kit of parts as recited in claim 12, comprising: arcuate trough, bearing blocks at front ends of the passages encircling the jackscrews.

16. A kit of parts as recited in claim 15, wherein enlarged rims adjacent the threaded sections are received within the bearing blocks.

17. A connector having a jackscrew mechanism comprising: interlocking covers encircling an electrical connector, creating one or more jackscrew receiving passages; a jackscrew for each of the passages, each jackscrew comprising, an engaging threaded tip, a restraining collar, and a restraining knob; a locking finger at the rear of the passage preventing jackscrew egress once the restraining collar is positioned forward of the locking finger; and an arcuate, through bearing block in each jackscrew passage receiving an enlarged rim adjacent to and rear of the threaded portion of one of the jackscrews when the restraining collar is forward of the locking finger.

18. A connector having a jackscrew mechanism comprising: interlocking covers encircling an electrical connector, creating one or more jackscrew receiving passages; a jackscrew for each of the passages, each jackscrew comprising an engaging threaded tip, a restraining collar, and a restraining knob; a locking finger at the rear of the passage preventing jackscrew egress once the restraining collar is positioned forward of the locking finger; and a width of an opening on each passage around a shaft of one of the jackscrews is limited by the width of the jackscrew shaft such that any angle of jackscrew ingress is not greater than the conic angle defined by the tip of the locking finger and the width of the opening.

19. A connector having a jackscrew mechanism comprising: interlocking covers encircling an electrical connector, creating one or more jackscrew receiving passages containing a series of guidance ramps; and a jackscrew for each of the passages, each jackscrew comprising, an engaging threaded tip, a restraining collar, a locking finger, and a restraining knob; and wherein the locking finger forms a ramp that faces a rear of the jackscrew passage that intercepts the jackscrew tip upon ingress of the jackscrew along the passage, and urges the jackscrew tip towards the first in the series of guidance ramps.

20. A connector having a jackscrew mechanism comprising: interlocking covers encircling an electrical connector, creating one or more jackscrew receiving passages containing a series of guidance ramps; and a jackscrew for each of the passages, each jackscrew comprising, an engaging threaded tip, a restraining collar, a locking finger, and a restraining know; and wherein the distance between the locking finger and the first ramp is not less than the length of the threaded portion of the jackscrew.

* * * * *